US005193922A

United States Patent [19]

Hayashi

[11] Patent Number: 5,193,922

[45] Date of Patent: Mar. 16, 1993

[54] SERIAL PRINTER

[75] Inventor: Mikio Hayashi, Tokyo, Japan

[73] Assignee: Seikosha Co., Ltd., Tokyo, Japan

[21] Appl. No.: 688,010

[22] Filed: Apr. 19, 1991

[30] Foreign Application Priority Data

Apr. 24, 1990 [JP] Japan ..... 2-108068

[51] Int. Cl.[5] ..... B41J 9/02

[52] U.S. Cl. ..... 400/157.1; 400/124; 400/118

[58] Field of Search ..... 400/118, 124, 157.1, 400/389, 390, 391.4; 101/93.01

[56] References Cited

U.S. PATENT DOCUMENTS 4,407,193 10/1983 Hall et al. ..... 101/93.01
4,428,284 1/1984 Thorne ..... 400/121
4,732,498 3/1988 Vermot-Gand et al. ..... 400/124
5,039,237 8/1991 Tanuma et al. ..... 400/124

FOREIGN PATENT DOCUMENTS 0020790 1/1986 Japan ..... 400/157.1
0998139 2/1983 U.S.S.R. ..... 400/124

*Primary Examiner*—Edgar S. Burr
*Assistant Examiner*—Lynn D. Hendrickson
*Attorney, Agent, or Firm*—Jordan and Hamburg

[57] ABSTRACT

A serial printer for printing recording paper has a printing head movable at a right angle with respect to the feeding direction of the recording paper. Vibration applying means, such as a piezoelectric element, is mounted on the outer circumference of the printing head for vibrating the printing head finely during the printing operation.

1 Claim, 2 Drawing Sheets

SERIAL PRINTER

FIELD OF THE INVENTION

The present invention relates to a serial printer for printing recording paper.

BACKGROUND OF THE INVENTION

Some printers are of the serial type in which the printing head is moved at a right angle with respect to the feeding direction of the recording paper.

In a printer of this type, it has been proposed that a platen facing the printing head be rotated in the printing operation (as disclosed in Japanese Patent Laid-Open No. 41285/1984).

Due to the rotation of the platen, according to this structure, the printing energy can be augmented by low power without applying a high drive voltage to the printing head. Especially in an impact type structure, the copying ability (in terms of the number of copies) can be improved by little power to provide an economic advantage.

According to this structure, however, the platen has to be rotated at a high speed in accordance with the printing operation of the printing head so as to augment the printing energy effectively. This raises a problem that the structure is complicated.

In view of the above, therefore, the present invention has as an object to provide a serial printer which can augment the printing energy with a low power and with a simple structure.

SUMMARY OF THE INVENTION

According to the present invention, there is provided a serial printer comprising a printing head movable at a right angle with respect to the feeding direction of the recording paper, wherein the improvement comprises vibration applying means mounted on the outer circumference of the printing head for vibrating the printing head finely at the time of the printing operation.

The vibration applying means is mounted on the back of the printing head for vibrating the printing head finely at a right angle with respect to a printing face.

The vibration applying means is mounted on the circumferential portion of the printing head for vibrating the printing head finely in parallel to the printing face.

The vibration applying means is mounted on the circumferential portion of the nose portion of the printing head for vibrating the printing head finely in parallel to the printing face.

The vibration applying means is mounted on the circumferential portion of either the printing head or the nose portion of the printing portion, namely, on two faces substantially normal to each other so that the printing head or said nose portion may perform a circular motion.

The vibration applying means is a piezoelectric element.

According to the present invention thus constructed, the printing head is finely vibrated during the printing operation by the vibration applying means so that the kinetic energy is applied to the printing element of the printing head by those vibrations to augment the printing energy. The vibration applying means can be exemplified by a piezoelectric element or the like to vibrate the printing head finely with low power and with a simple structure.

DESCRIPTION OF THE PREFERRED EMBODIMENTS

Figure 1:
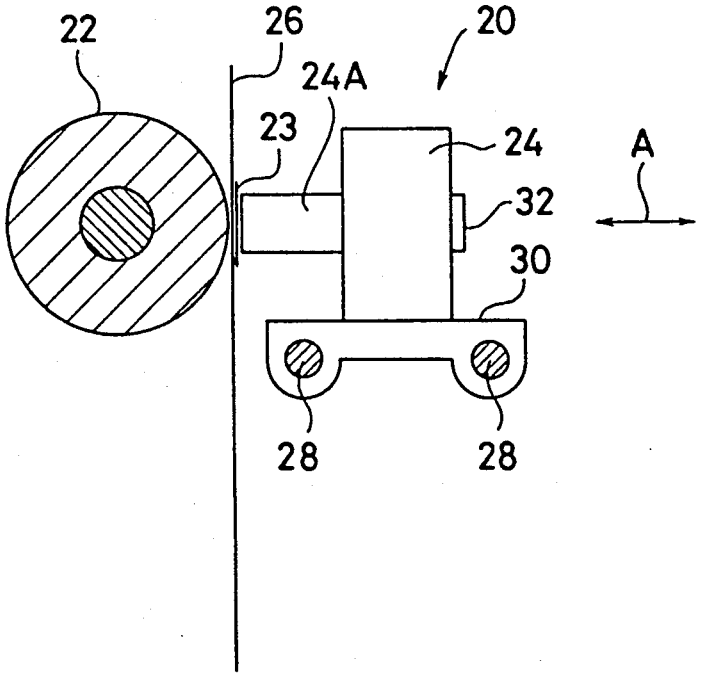
FIG. 1 is a sectional view showing the printer to which the present invention is applied.

FIG. 1 shows a printer 20 to which the present invention is applied.

In printer 20, a printing head 24 has its nose portion 24A arranged to face a platen 22, and an ink ribbon 23 is arranged between the platen 22 and the nose portion 24A of the printing head 24. During printing, recording paper 26 is arranged between the platen 22 and the ink ribbon 24.

The printing head 24 is carried on a carriage 30, which is so supported that it can slide axially of the platen 22 through guide pins 28. During printing, the printing head 24 is scanned axially of the platen 22, i.e., at a right angle with respect to the feeding direction of the recording paper 26 through the carriage 30. The nose portion 24A of the printing head 24 has a non-illustrated printing element packaged therein to impinge against the recording paper 26 through the ink ribbon 23 while being backed by the platen 22 by the application of the drive voltage. By the action of this printing element, the recording paper 26 can be printed with the ink of the ink ribbon 23. The printing head 24 thus having such printing element packaged therein is well known, as exemplified by a wire type, a printing ball or a petal-shaped printing wheel.

This printing head 24 is finely vibrated during the printing operation. More specifically, there is attached to the back of the printing head 24 a piezoelectric element 32 acting as the vibration applying means, which is supplied with a pulse voltage during the printing operation. When this pulse voltage is applied, the piezoelectric element 32 is contracted to vibrate the nose portion 24A of the printing head 24 finely at a right angle (in the direction of arrow A) with respect to the printing face.

Next, the operation of the illustrated embodiment of the present invention will be described.

During printing, a drive voltage is applied to the printing head 24, and a pulse voltage is applied to the piezoelectric element 32. By the application of the drive voltage, the printing element of the printing head 24 is brought into impingement against the recording paper 26 through the ink ribbon 23 while being backed by the platen 22. By this action, the recording paper 26 is desirably printed with the ink of the ink ribbon 23. By the application of the pulse voltage, on the other hand, the piezoelectric element 32 is contracted to vibrate the nose portion 24A of the printing head 24 finely at a right angle with respect to the printing face of the recording paper 26.

As a result, during printing, the nose portion 24A of the printing head 24 is finely vibrated so that the printing element is brought into impingement against the recording paper 26 through the ink ribbon 23 while being backed by the platen 22. Thus, the kinetic energy due to the vibration is applied to the printing element of the printing head 24 to augment the printing energy. As a result, the printing paper 26 can be densely printed, and the copying ability (or the number of copies) for copying a plurality of sheets of recording paper 26 is improved.

Thus, according to the present invention, the printing energy can be augmented with low power and with a simple structure merely by attaching the piezoelectric element 32 to the printing head 24 to apply the pulse voltage to the piezoelectric element 32.

In the embodiment thus far described, the piezoelectric element 32 is attached to the back of the printing head 24 to vibrate the nose portion 24A of the printing head 24 at a right angle with respect to the printing face of the recording paper 26. However, the piezoelectric element 32 may be attached to either the circumferential portion of the printing head or the circumferential portion of the nose portion 24A of the printing head 24 to vibrate the nose portion 24A of the printing head 24 finely in parallel with the printing face of the recording paper 26. Simultaneously, as the printing element of the printing head 24 impinges against the recording paper 26 through the ink ribbon 23 while being backed by the platen 22, the printing element is rubbed by the recording paper 26 through the ink ribbon 23 by the vibration of the nose portion 24A.

Figure 2:
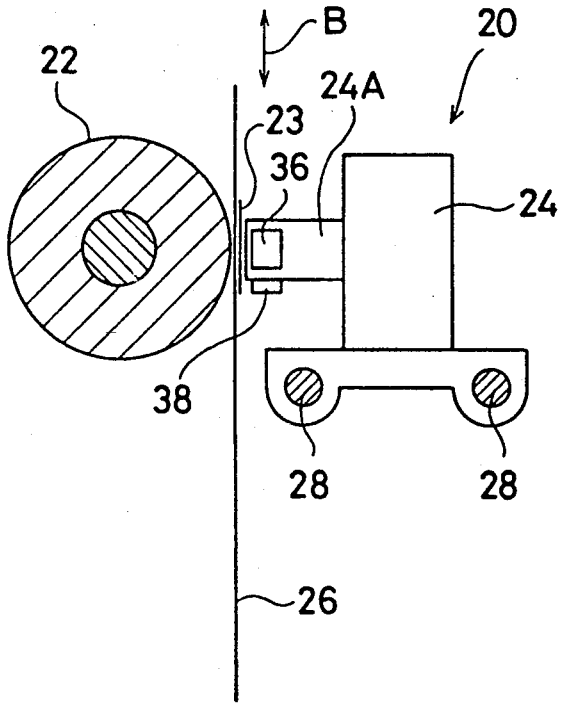
FIG. 2 is a sectional view showing another embodiment in a manner to correspond to FIG. 1.

If, on the other hand, piezoelectric elements 36 and 38 are attached to two faces which are substantially normal to each other, as shown in FIG. 2, the nose portion 24A of the printing head 24 can be finely vibrated in two directions (i.e., the direction of arrow B and normal to the drawing sheet) which are parallel to the printing face of the recording paper 26 and perpendicular to each other, so that it can be caused to perform a circular motion. This motion can provide the same operational effect as the aforementioned one. With this structure, moreover, the dots of the nose portion 24A can be formed larger than the ordinary ones so that an image having a gradation can be expressed by controlling the voltages to be applied to the piezoelectric elements 36 and 38. In addition to the piezoelectric elements 36 and 38, there may be attached to the back of the printing head 24 another piezoelectric element for vibrating the nose portion 24A of the printing head 24 finely in three dimensions.

In the embodiments thus far described, the means for vibrating the printing head 24 finely is exemplified by piezoelectric elements, but it is also possible to apply other vibration applying means such as a spring and a magnetic force for vibrating the printing head 24 finely.

Moreover, the foregoing embodiments are directed to the so-called "impact type" printers, in which the printing element of the printing head 24 is caused to impact against the recording paper 26 through the ink ribbon 23 while being backed by the platen 22. However, the present invention can also be applied to the so-called "non-impact type" printer such as an ink jet type or the thermal type.

In the serial printer according to the present invention, as has been described hereinbefore, the outer circumference of the printing head is equipped with the vibration applying means for vibrating the printing head finely during the printing operation. As a result, there can be attained an excellent effect in that the kinetic energy can be applied to the printing element of the printing head with low power and with a simple structure to thereby augment the printing energy.

I claim:

1. A serial printer comprising a printing head having a printing element and being movable at a right angle with respect to the feeding direction of a recording paper to be printed, means to move and impart kinetic energy to said printing element to cause said printing element to record on a recording paper, and means to increase the kinetic energy which is imparted to said printing element to increase the printing energy with which said printing element prints on said recording paper, said means to increase the kinetic energy including vibration applying means mounted on both a side and on the back of said printing head for vibrating said entire printing head during the printing operation.

* * * * *